United States Patent [19]

Reale

[11] 4,144,973

[45] Mar. 20, 1979

[54] COMBINATION HOIST AND MOUNT

[76] Inventor: Salvatore Reale, Rte. #1, Box 198, Preston, Md. 21655

[21] Appl. No.: 904,037

[22] Filed: May 8, 1978

Related U.S. Application Data

[63] Continuation-in-part of Ser. No. 764,967, Feb. 2, 1977, abandoned.

[51] Int. Cl.[2] ..... B66C 23/00

[52] U.S. Cl. ..... 212/8 R; 254/8 R; 414/728

[58] Field of Search ..... 214/130 R; 212/8 R, 212/58 R, 59 R, 56, 62, 65; 254/2 R, 8 R

[56] References Cited

U.S. PATENT DOCUMENTS

| | | | |
|---|---|---|---|
| 2,974,809 | 3/1961 | Sellers et al. | 212/65 |
| 3,018,005 | 1/1962 | Renshaw | 214/130 R |
| 3,074,562 | 1/1963 | Clayborne et al. | 212/63 |
| 3,084,808 | 4/1963 | Peduzzi et al. | 212/63 |

*Primary Examiner*—Lawrence J. Oresky

[57] ABSTRACT

This is a new and unique machine which organizes older, recognized and established methods of handling objects and machinery into a more economical, efficient method by recombining articles of present day usage into a new concept. An ordinary conventional automotive hydraulic jack is used to replace the fixed jacking arrangement found on machines of this type. The use of a threaded screw mechanism working in conjunction with a moveable trolley arrangement makes it easier to handle a load and makes it possible for this machine to accomplish comparable results in the handling of objects and machinery as was formerly required by two different and distinct machines.

1 Claim, 3 Drawing Figures

COMBINATION HOIST AND MOUNT

CROSS REFERENCE TO RELATED APPLICATIONS

This application is a continuation in part of Ser. No. 764,967 filed Feb. 2, 1977 now abandoned.

SUMMARY OF INVENTION

It is an object of this invention to provide a new means of hoisting machinery and objects and also to make it easier to perform work on machinery and objects by providing a means of securing said machinery and objects whereby they may be more easily manipulated in the performance of work or repairs upon said machinery or objects.

In accordance with the present invention there is provided a hoisting device which is portable being mounted upon a framed dolly which is itself mounted upon castor wheels, with said framed dolly having forwardly projecting legs themselves connected at their rearward ends to a crossbar with said crossbar extending laterally beyond the point of conection of said legs and with conventional type floor locks provided at the ends of said cross bar providing stability, with a vertical housing provided which forms support for a rotatable mount which is rotatably attached to the front of said housing, with said vertical housing providing support for a conventional automotive type hydraulic jacking device and also providing means for vertically guiding a first trolley with with said trolley being connected to a lifting arm and with the upper portion of the lifting arm being pivotally connected to a swinging boom, with boom arrangement being pivotally connected at the rear end of said boom and supporting a second trolley dependant upon a hand operated screw attachment for the movement of the trolley along said boom.

DESCRIPTION OF THE DRAWINGS

A device which is a specific embodiment of the invention will be illustrated with the following drawings.

DESCRIPTION OF THE PREFERRED EMBODIMENTS

Figure 1:
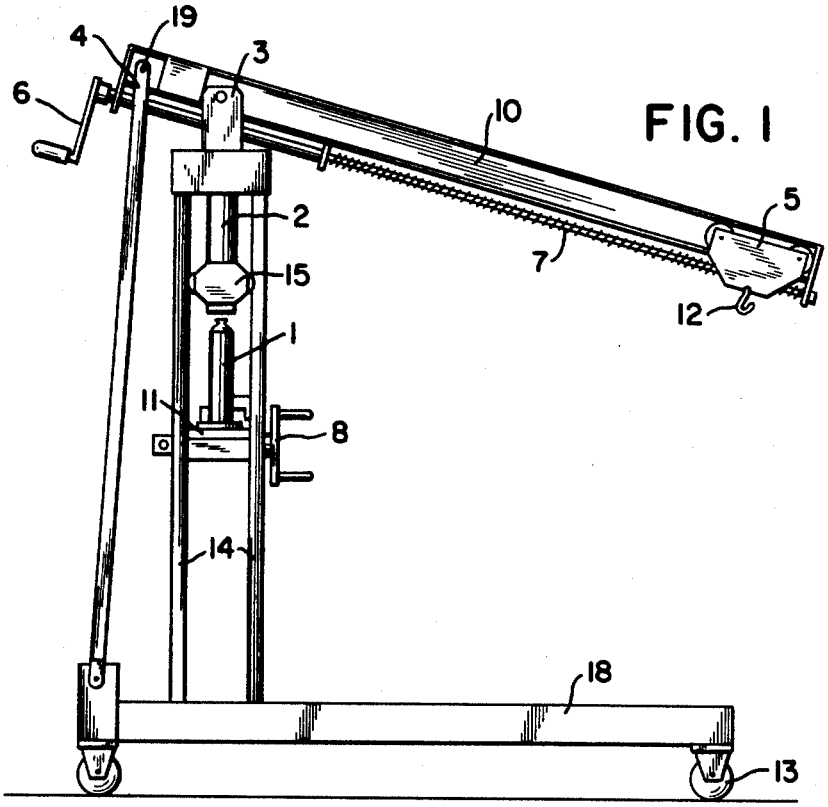
FIG. 1 a side view of the device showing the hydraulic jack in place in the housing with the boom in the extreme down position and with the second trolley at the extreme end of the boom.
Figure 2:
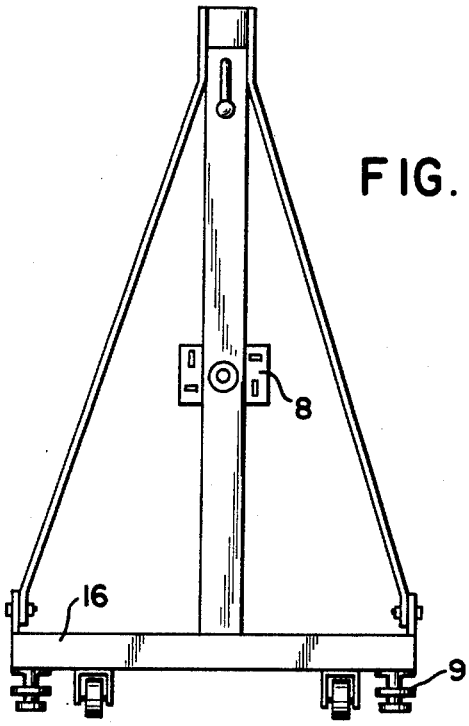
FIG. 2 Rear end view showing the conventional type floor locks located at the ends of the cross beam and the rotatable mount.
Figure 3:
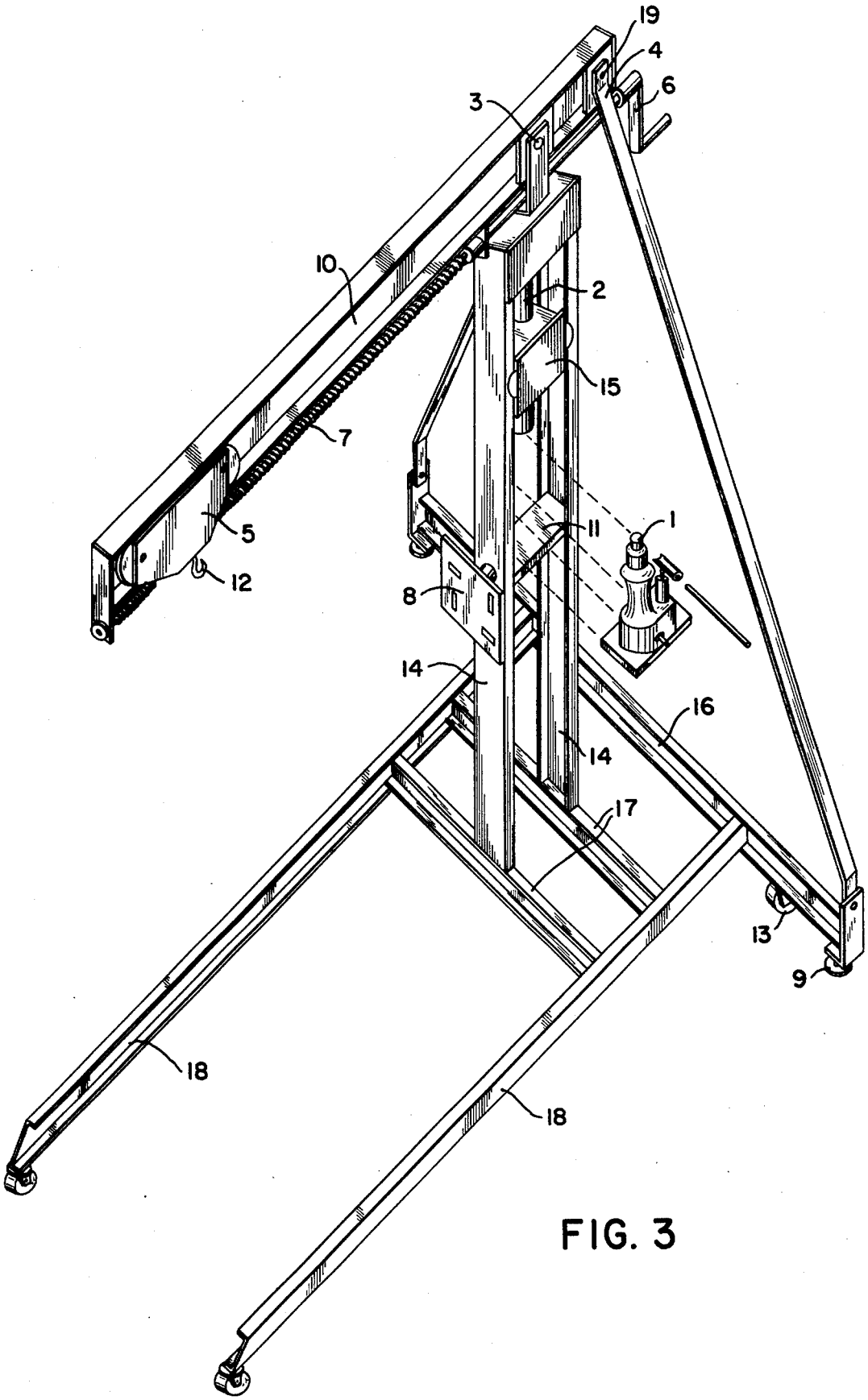
FIG. 3. A general isometric view showing the conventional type jacking device removed from the vertical housing and another view of the rotatable mount.

The device consists of a framed dolly composed of a pair of forwardly projecting legs 18, rigidly connected together at their rearward ends by a crossbar 16, and intermediately by crossbeams 17, with the crossbar being provided at each end with a conventional type floor lock means 9, further identification of said floor lock means may be made by consulting page #290 of the W. W. Grainger Co. Inc of Baltimore Catalog Spring of 1975, with said floor lock means provided for selectively engaging a floor and thereby resisting movement of said device. The framed dolly being provided with four conventional type castor wheels 13, with each of the projecting legs being provided with a castor wheel at it's forward end and the crossbar being provided with two castor wheels with each wheel being located inwardly towards the center of the device away from the location of the floorlocks. A rigidly connected vertical housing 14, with said vertical housing securely connected to the top of the crossbeams and with said crossbeams themselves rigidly connected to and extending between the projecting legs and being positioned intermediate to the ends of said legs. A rotating mount means 8, rotatably attached to the front of said vertical housing. A horizontal plate 11, securely attached to the interior portion of said vertical housing between the ends thereof. A vertically guided first trolley 15, located above said horizontal plate with said trolley being guided along said housing and to the top of the trolley being securely fastened a lifting bar 2, with the upper portion of said lifting bar having a first pivoted connection 3, thereby rotatably connecting the upper portion of said lifting bar to the boom 10, located above said lifting bar. A pair of links 4, each pivotally connected to one end of said cross bar and the other end pivotally connected to said boom at a rearward pivot point 19, of said first pivoted connection. A second integrated with a nut arrangement 5, supported for movement along the boom and having a load handling hook 12 depending therefrom. Said trolley and nut arrangement being engaged to a screw means 7, which when undergoing rotation has the effect of moving said second trolley along said boom with the actuation of a hand operated crank 6, which is attached at the rear end of said screw means and thereby providing means for turning said screw and thereby actuating said trolley. A jack means 1, consisting of a conventional type automotive hydraulic jack such as may be seen on page # 655 of Sears and Roebuck 1978 Spring and Summer Mail Order Catalog, with said jack means capable of providing a vertical force between said horizontal plate and said first trolley, thereby having the effect of pivoting the boom about the first pivoted connection.

I claim:

1. A hoisting device comprising:

(a) a framed dolly mounted on castor wheels, said framed dolly having a pair of forwardly projecting legs connected at their rearward ends to a crossbar which extends laterally beyond the point of connection of said legs, (b) a pair of crossbeams connected to and extending between said legs and intermediate the ends of said legs, (c) a vertical housing connected to said pair of cross beams, (d) a rotating mount means rotatably attached to the front of said housing for mounting a portion of the load to be carried, (e) a horizontal plate attached to the interior portion of said housing between the ends thereof, (f) a boom (g) a vertically guided first trolley above said horizontal plate, said first trolley being guided along said housing and having a first pivoted connection to boom above said first trolley, (h) a pair of links each end pivotally connected to one end of said crossbar and the other end pivotally connected to said boom at a pivot point rearward of said first pivoted connection, (i) a second trolley supported for movement along said boom and having a load handling hook depending therefrom, (j) means to move said second trolley along said boom comprising a nut arrangement connected to said second trolley and a screw means connected to said boom to move said trolley by means of a hand operated crank connected to said screw means, (k) floor lock means connected to the ends of said crossbar for selectively engaging a floor and resisting movement of said device, (l) jack means for applying a vertical force between said horizontal plate and said first trolley thereby pivoting said boom about said pivot point, said jack means being free of connection to either said horizontal plate or said first trolley and thus being easily removable, and in use in the device, when inserted between said horizontal plate and said trolley, acting only to abut said horizontal plate and said trolley to provide the vertical force there between.

* * * * *